US012241181B2

(12) United States Patent
Horinouchi et al.

(10) Patent No.: US 12,241,181 B2
(45) Date of Patent: Mar. 4, 2025

(54) CARBON FIBER BUNDLE AND PRODUCTION METHOD THEREOF

(71) Applicant: Toray Industries, Inc., Tokyo (JP)

(72) Inventors: Ayanobu Horinouchi, Otsu (JP); Fumitaka Watanabe, Otsu (JP); Yuuki Okishima, Ehime (JP)

(73) Assignee: Toray Industries, Inc., Tokyo (JP)

( * ) Notice: Subject to any disclaimer, the term of this patent is extended or adjusted under 35 U.S.C. 154(b) by 494 days.

(21) Appl. No.: 17/599,304

(22) PCT Filed: Feb. 26, 2020

(86) PCT No.: PCT/JP2020/007690
§ 371 (c)(1),
(2) Date: Sep. 28, 2021

(87) PCT Pub. No.: WO2020/195476
PCT Pub. Date: Oct. 1, 2020

(65) Prior Publication Data

US 2022/0170183 A1 Jun. 2, 2022

(30) Foreign Application Priority Data

Mar. 28, 2019 (JP) ..... 2019-063202

(51) Int. Cl.
*D01F 9/22* (2006.01)

(52) U.S. Cl.
CPC ..... *D01F 9/225* (2013.01)

(58) Field of Classification Search
CPC ..... D01F 9/12–328; D01F 9/21–225
See application file for complete search history.

(56) References Cited

U.S. PATENT DOCUMENTS

| | | | | |
|---|---|---|---|---|
| 5,256,343 | A | 10/1993 | Suto et al. | |
| 2012/0088104 | A1* | 4/2012 | Hashimoto | D01D 5/247 428/401 |
| 2017/0067187 | A1* | 3/2017 | Watanabe | C01B 32/18 |

FOREIGN PATENT DOCUMENTS

| | | | | |
|---|---|---|---|---|
| CN | 102677209 | | | 9/2012 |
| CN | 104264286 | | | 1/2015 |
| JP | 63-303123 | | | 12/1988 |
| JP | 11-124744 | A | | 5/1999 |
| JP | 2004-277907 | | | 10/2004 |
| JP | 2004277907 | A | * | 10/2004 |
| JP | 2006-169672 | | | 6/2006 |
| JP | 2011-202336 | A | | 10/2011 |
| JP | 2011-241507 | | | 12/2011 |
| JP | 4945684 | | | 6/2012 |
| JP | 2014-160312 | A | | 9/2014 |
| JP | 2015203166 | A | * | 11/2015 |
| JP | 6359860 | | | 7/2018 |
| KR | 10-1407127 | | | 6/2014 |

OTHER PUBLICATIONS

"JP2015203166_Machine Translation" is a machine translation of JP-2015203166-A. (Year: 2015).*
"JP2004277907_Machine Translation" is a machine translation of JP-2004277907-A. (Year: 2004).*

* cited by examiner

*Primary Examiner* — Larissa Rowe Emrich
(74) *Attorney, Agent, or Firm* — DLA Piper LLP (US)

(57) ABSTRACT

A method of producing a carbon fiber bundle suppresses penetration of a process oil agent into the fiber surface layer and suppresses adhesion between fibers and the generation of surface voids, and also provides a carbon fiber bundle. The carbon fiber bundle is characterized by having a crystallite size of 3.0 nm or less as measured by wide-angle X-ray diffraction, containing a point where the Si/C ratio is 10 or more as calculated by SIMS (secondary ion mass spectrometry) in the region ranging from 0 to 10 nm in depth from the fiber surface, and also showing a Si/C ratio of 1.0 or less as calculated by SIMS at a depth of 10 nm from the fiber surface.

1 Claim, No Drawings

CARBON FIBER BUNDLE AND PRODUCTION METHOD THEREOF

TECHNICAL FIELD

This disclosure relates to a carbon fiber bundle that can be used suitably for manufacturing aircraft members, automobile members, and ship members, as well as sporting goods such as golf shafts and fishing rods and other general industrial applications.

BACKGROUND

Being higher in specific strength and specific modulus than other fibers, carbon fiber has been used widely as reinforcing fiber for composite materials in conventional sporting goods, aviation and aerospace products, automobiles, civil engineering and construction materials, and other general industrial products such as pressure vessel and windmill blade, and now there is strong demand for carbon fiber products having further improved performance (increased strand tensile strength, in particular).

In polyacrylonitrile (hereinafter occasionally PAN) based carbon fiber, which is the most widely used carbon fiber, the industrial production process includes spinning a spinning dope solution containing a precursory PAN based polymer mainly by the wet spinning technique, dry-jet wet spinning technique or the like to produce precursor fiber for carbon fiber, and subsequently heating it in an oxidizing atmosphere at 200° C. to 300° C. to convert it into a stabilized fiber, followed by heating it in an inert atmosphere at at least 1,200° C. to carbonize it.

Since carbon fiber is a brittle material, its improvement in strand tensile strength requires thorough elimination of flaws. Breakage of carbon fiber often starts at its surface. In particular, products available in recent years have improved quality due to optimized processes, and most of them are likely to start to break from flaws located in the outermost region located within 10 nm from the fiber surface. Except for damage and dents that occurs during production steps, flaws in carbon fiber surfaces can be broken down into three groups of those attributed mainly to adhesion between fibers that occurs during stabilization treatment, those attributed to hole-like flaws (void flaws) existing in fiber surface layers, and those attributed to chemical modification of fiber surface layers, and these are closely related to the process oil agent supplied during the spinning of precursor fiber bundles for carbon fiber.

In general, a silicone based process oil agent is applied to precursor fiber for carbon fiber with the aim of preventing adhesion between fibers from being caused by heating during the stabilization process. This significantly suppresses adhesion between fibers, thereby improving the strand tensile strength. However, adhesion between fibers may fail to be suppressed sufficiently due to uneven oil application on the fiber and, in addition, the process oil agent may penetrate into the precursor fiber, leading to retention of the process oil agent in microstructures of the precursor fiber. This can induce hole-like flaws (void flaws) of several to several tens of nanometers in the region within 50 nm depth from the fiber surface. Furthermore, even if such hole-like flaws are not formed, atomic defects can occur due to Si atoms contained in the fiber surface layer and, accordingly, actual improvement in strength is limited even when the generation of void flows is suppressed.

So far, several proposals have been made for the purpose of improving the uniform adhesion of a process oil agent to precursor fiber and suppressing the penetration of a process oil agent into the precursor fiber. Japanese Unexamined Patent Publication (Kokai) No. 2014-160312 proposes a technique to improve the uniform adhesion of a process oil agent to fiber by controlling the denseness and tension of precursor fiber in the oil application step. Japanese Patent No. 6359860 proposes a technique in which precursor fiber is stretched as high as eight times or more before the application of an oil agent to improve the denseness of the precursor fiber, thereby suppressing the penetration of the oil agent. Japanese Patent No. 4945684 proposes the use of a coagulation bath liquid having a low coagulation rate so that precursor fiber containing an organic solvent is allowed to be stretched to an appropriate ratio to improve its denseness and suppress the generation of void flaws. Japanese Unexamined Patent Publication (Kokai) No. 2011-202336 proposes a technique in which a mixture of a silicone based oil agent and a non-silicone based oil agent is used as a mixed process oil agent to ensure a reduced concentration of silicone penetrating into the fiber, thereby suppressing the amount of penetration of silicone into the fiber. Japanese Unexamined Patent Publication (Kokai) No. HEI 11-124744 proposes a technique in which a silicone oil agent is applied in two stages to achieve highly uniform adhesion of the oil agent to the fiber bundle, thereby suppressing the penetration of the oil agent into the fiber.

However, although achieving improved uniform adhesion of an oil agent, the technique proposed in Japanese Unexamined Patent Publication (Kokai) No. 2014-160312 is not able to sufficiently prevent a process oil agent from penetrating into the fiber in the region near the outermost surface of the fiber (within about 10 nm depth from the fiber surface), which is the most important factor in strand tensile strength. The technique proposed in Japanese Patent No. 6359860 actually suppresses the penetration of a process oil agent into precursor fiber, but is not sufficiently effective in suppressing the penetration of an oil agent into the region near the outermost surface and, in addition, the stretching ratio is so high that the take-up speed in the oil agent application process has to be increased, leading to the problem of deterioration in the uniform adhesion of the process oil agent. Although actually depressing the generation of void flaws, the technique proposed in Japanese Patent No. 4945684 is not sufficiently effective in suppressing the penetration of a process oil agent into the region near the outermost surface and, in addition, it is stretched after containing an organic solvent, leading to the problem of inducing adhesion between fibers. The technique proposed in Japanese Unexamined Patent Publication (Kokai) No. 2011-202336 actually suppresses the penetration of a silicone oil agent into the fiber in a pseudo manner, but it is not sufficiently effective in suppressing the adhesion between fibers compared to silicone oils that do not contain non-silicone components, and even when using a non-silicone component, it will form an atomic defect after penetrating into the fiber, resulting in limited ability to develop a high strand tensile strength. Although able to suppress the penetration of an oil agent into the region within 50 to 100 nm depth from the fiber surface, the technique proposed in Japanese Unexamined Patent Publication (Kokai) No. HEI 11-124744 has difficulty in suppressing its penetration into the region near the outermost surface of the fiber and has the problem of requiring a multi-stage process. As described above, there have been no conventional techniques that can suppress the penetration of a process oil agent particularly into the region near the outermost surface of the fiber (within about 10 nm depth from the fiber surface) and can also suppress adhesion between fibers and the generation of void flaws.

Thus, it could be helpful to provide 1) a method of producing a carbon fiber bundle that suppresses penetration of a process oil agent into the fiber surface layer and also suppresses adhesion between fibers and generation of surface voids, and 2) a carbon fiber bundle.

SUMMARY

We thus provide:

A carbon fiber bundle production method in which a polyacrylonitrile copolymer solution is extruded from a spinneret into the air, immersed in a coagulation bath liquid stored in a coagulation bath, pulled out from the coagulation bath liquid into the air to form a coagulated fiber bundle, subsequently subjected to at least a washing process in water, a stretching process, an oil agent application process, and a drying process to form a precursor fiber bundle for carbon fiber, further subjected to a stabilization process for stabilizing the precursor fiber bundle for carbon fiber in an oxidizing atmosphere at a temperature of 200° C. to 300° C., a pre-carbonization process for performing pre-carbonization treatment in an inert atmosphere at a maximum temperature of 500° C. to 1,200° C., and a carbonization process for performing carbonization treatment in an inert atmosphere at a maximum temperature of 1,200° C. to 2,000° C., wherein the coagulation bath liquid contains 70% to 85% of at least one organic solvent selected from the group consisting of dimethyl sulfoxide, dimethyl formamide, and dimethyl acetamide, and has a temperature of −20° C. to 20° C.; the immersion period of the polyacrylonitrile copolymer solution in the coagulation bath liquid is 0.1 to 4 seconds; and an in-air holding process for holding the coagulated fiber bundle in the air for 10 seconds or more is performed after pulling it out from the coagulation bath liquid into the air and before performing the washing process in water.

The carbon fiber bundle is also characterized by having a crystallite size (Lc) of 3.0 nm or less as measured by wide-angle X-ray diffraction, containing a point where the Si/C ratio is 10 or more as calculated by SIMS (secondary ion mass spectrometry) in the region ranging from 0 to 10 nm in depth from the monofilament fiber surface, and showing a Si/C ratio of 1.0 or less as calculated by SIMS at a depth of 10 nm from the fiber surface.

Penetration of a process oil agent into the fiber surface layer is thereby suppressed and at the same time, adhesion between fibers and the generation of surface voids are also suppressed to achieve the production of a carbon fiber bundle having a high strand tensile strength.

DETAILED DESCRIPTION

Production Method for Carbon Fiber Bundle

Spinning Method

The dry jet wet spinning method is adopted for the spinning step performed in producing a coagulated fiber bundle. The dry jet wet spinning method is a spinning method in which polyacrylonitrile (PAN) copolymer solution, which is used as spinning dope solution, is extruded from a spinneret into the air, immersed in a coagulation bath liquid stored in a coagulation bath, and pulled out from the coagulation bath liquid into the air to form a coagulated fiber bundle. If carrying out the wet spinning method, streaky irregularities of several tens of nanometers or more are likely to be formed in the fiber axis direction on the fiber surface, and these irregularities will act as flaws to cause breakage, showing that it is difficult to improve the strand tensile strength if using this procedure.

PAN Copolymer Solution

The polymer to be used in the PAN copolymer solution is a PAN copolymer (polyacrylonitrile, a copolymer containing polyacrylonitrile as primary component, or a mixture containing polyacrylonitrile as primary component). "Containing polyacrylonitrile as primary component" means that acrylonitrile accounts for 85 to 100 mol % of the polymer units in a copolymer containing polyacrylonitrile as primary component and that copolymers containing polyacrylonitrile as primary component account for 85 to 100 mass % of the mixture in a mixture containing polyacrylonitrile as primary component. As the solvent in the PAN copolymer solution, at least one organic solvent selected from the group consisting of dimethyl sulfoxide, dimethyl formamide, and dimethyl acetamide should be used. The temperature of the PAN copolymer solution to be extruded from the spinneret is not particularly limited, and an appropriate temperature may be adopted from the viewpoint of extrusion stability.

Coagulation Bath

For the coagulation bath liquid, at least one organic solvent selected from the group consisting of dimethyl sulfoxide, dimethyl formamide, and dimethyl acetamide, i.e., the same as those listed above for the solvent of the PAN copolymer solution, is used in the form of a mixture with a so-called coagulant. It is preferable to use water as the coagulant. The concentration of the organic solvent in the coagulation bath liquid is a very important factor. As a major feature, coagulation is not completed in the coagulation bath liquid, but the spinning dope solution is in a semi-coagulated state as it passes through the coagulation bath liquid and then continues to coagulate slowly in the air. Therefore, it is necessary to use a coagulation bath liquid that maintains a slow coagulation rate. The content of the organic solvent should be 70 to 85 mass %, preferably 75 to 82 mass %. If the concentration of the organic solvent in the coagulation bath liquid is too low, the coagulation rate will be fast, making it difficult for the spinning dope solution to stay in a semi-coagulated state as it passes through the coagulation bath liquid, whereas if it is high, the coagulation rate will be very slow to make fiberization difficult, and larger numbers of voids will be formed in the surface layer of the resulting carbon fiber. The temperature of the coagulation bath liquid should be −20° C. to 20° C., preferably −10° C. to 10° C. With a lowering temperature of the coagulation bath liquid, the coagulation rate decreases to allow the spinning dope solution to easily stay in a semi-coagulated state as it passes through the coagulation bath liquid, whereas with a rising temperature, the coagulation rate increases to make it difficult for the spinning dope solution to stay in a semi-coagulated state as it passes through the coagulation bath liquid. The formation of voids in the surface layer is suppressed more strongly as the temperature of the coagulation bath liquid decreases.

Coagulation Process

The immersion time of the spinning dope solution in the coagulation bath liquid should be 0.1 to 4 seconds, preferably 0.1 to 2 seconds, and more preferably 0.1 to 1 second. As the immersion time in the coagulation bath liquid becomes too short, fiberization becomes more difficult, whereas as the immersion time becomes too long, it becomes more difficult for the spinning dope solution to stay in a semi-coagulated state as it passes through the coagulation bath liquid. The immersion time in the coagulation bath liquid can be controlled by changing the length immersed in the coagulation bath liquid or changing the take-up speed of the spinning dope solution.

In a semi-coagulated state, by definition, the solvent exchange between the spinning dope solution and the coagulant in the coagulation bath liquid has not been completed in the coagulation bath liquid. Solvent exchange means interdiffusion that occurs between the organic solvent (solvent) in a spinning dope solution and the coagulant outside the spinning dope solution to achieve uniform concentration, and it reaches completion when the concentrations of the organic solvent and coagulation accelerator in the spinning dope solution become identical to the concentrations of the solvent and coagulation accelerator outside the spinning dope solution. If solvent exchange is completed in a coagulation bath liquid, that is, if coagulation is completed in a coagulation bath liquid, therefore, the concentration of the organic solvent and the concentration of the coagulation accelerator in the spinning dope solution become identical to that of the coagulation bath liquid in the coagulation bath liquid. If solvent exchange is not completed in the coagulation bath liquid, that is, if the spinning dope solution has not been coagulated completely, but is in a semi-coagulated state, at the time when it is pulled out from the coagulation bath liquid into the air, on the other hand, the concentration of the organic solvent in the liquid existing around the coagulated fiber bundle after passing through the coagulation bath liquid becomes higher over time than the concentration of the organic solvent in the coagulation bath liquid. This is because solvent exchange progresses between the organic solvent in the spinning dope solution that is in a semi-coagulated state after passing through the coagulation bath liquid and the coagulant in the liquid existing around it. The solvent exchange that progresses after passing through the coagulation bath liquid occurs in an in-air holding process as described below, but it is characterized by progressing very slowly compared to the solvent exchange that occurs in the coagulation bath liquid.

In-the-Air Holding Process

An in-air holding process that holds the spinning dope solution in the air is performed for 10 seconds or more after the spinning dope solution in a semi-coagulated state has passed through the coagulation bath liquid. This in-air holding process should be carried out immediately after the passage of the spinning dope solution through the coagulation bath liquid and before its introduction into the washing process in water. As a result, the coagulated fiber bundle in a semi-coagulated state after passing through the coagulation bath liquid is allowed to continue to coagulate slowly in the air, and the denseness of the fiber bundle improves considerably in this process, particularly in the surface layer. Such slow solvent exchange cannot occur in the coagulation bath liquid and can only be achieved through coagulation in the air. The in-air holding process should last for 10 seconds or more, preferably 30 seconds or more, and still more preferably 100 seconds or more. If the period of the in-air holding process is too short, the fiber bundle is introduced into the washing bath before its coagulation is not completed in the air, leading to a decreased denseness. The coagulation in the air reaches completion in not longer than 300 seconds, and it is impossible to achieve a greater effect if it is continued further. The desired effect can be realized even if the air temperature is not controlled during the in-air holding process, but its control at 5° C. to 50° C. is preferred because coagulation unevenness can be reduced. It is preferable that the concentration of the organic solvent in the liquid existing around the coagulated fiber bundle after being held in the air and immediately before being introduced into the washing bath be higher by 2% or more than the concentration of the organic solvent in the coagulation bath liquid. "The coagulated fiber bundle after being held in the air and immediately before being introduced into the washing bath" refers to the coagulated fiber bundle at a time point 0.3 second before being introduced into the washing bath. It is preferable that the concentration of the organic solvent in the liquid existing around the coagulated fiber bundle be higher than the concentration of the organic solvent in the coagulation bath liquid to allow the fiber bundle to have improved denseness, and it is preferably higher by 3% or more, more preferably 5% or more, than the concentration of the organic solvent in the coagulation bath liquid. The concentration of the organic solvent in the liquid existing around the coagulated fiber bundle can be controlled by changing the concentration of the organic solvent in the coagulation bath liquid, its temperature, the immersion period in the coagulation bath liquid, and the period of the in-air holding process. To determine the concentration of the organic solvent in the liquid existing around the coagulated fiber bundle, a sample is taken from the liquid existing around the coagulated fiber bundle traveling in the air and coming to the position 0.3 second before being introduced into the washing bath, and measurements are taken using a refractometer, gas chromatograph or the like.

Washing Process in Water, Stretching Process, Oil Agent Application Process, and Drying Process A PAN copolymer solution is semi-coagulated by introducing it into a coagulation bath liquid and then held in the air, followed by subjecting it to a washing process in water, stretching process, oil agent application process, and drying process to provide a precursor fiber bundle for carbon fiber.

In the washing process in water, the coagulated fiber bundle having passed through the in-air holding process is introduced into a washing bath with the aim of further removing the organic solvent from the coagulated fiber bundle. To improve the passability of the fiber traveling through the washing process in water, the fiber may be stretched to a ratio of 1 to 1.5 in the washing process in water.

Commonly, the stretching process can be carried out in a single or a plurality of stretching baths that are controlled at a temperature of 30° C. to 98° C. The stretching in a bath performed in the stretching process is referred to as drawing in water, and its ratio is referred to as the ratio of drawing in water. It is preferable for the ratio of drawing in water to be set to 2 to 2.8. If the total stretching ratio before the oil agent application process is more than 3, the denseness in the surface layer will decrease to allow the oil agent to penetrate easily into the fiber. The total stretching ratio before the oil agent application process means the product of the stretching ratio in the washing process in water multiplied by the ratio of drawing in water.

The oil agent application process is performed after the process of drawing in water with the aim of supplying an oil agent to prevent adhesion between fibers. For use in this process, it is preferable to adopt an oil agent containing silicone as primary component. If the oil agent used does not contain silicone, it will not work effectively in preventing adhesion between fibers in the stabilization process, resulting in a decrease in strand tensile strength. Furthermore, it is preferable for the silicone oil agent to contain a modified silicone such as amino-modified silicone that is high in heat resistance. Other good silicone oil agents include epoxy-modified ones and alkylene oxide-modified ones. The method to be used to supply a silicone oil agent is not particularly limited, but it should be performed in such a manner that a point where the ratio between the number of Si atoms and that of C atoms, which is referred to as the Si/C ratio and determined by SIMS (secondary ion mass spectrometry), is 10 or more exists in the region ranging from 0 to 10 nm in depth from the carbon fiber surface. If the Si/C ratio is 10 or less, the adhesion between fibers will not be suppressed sufficiently, resulting in a decrease in strand tensile strength.

For the drying process, a generally known method may be selected appropriately. In addition, from the viewpoint of improving the productivity and improving the orientation parameter of crystallites, it is preferable to carry out stretching in a heated heat medium after the drying process. Such heat mediums useful for heating include, for example, compressed steam and superheated steam, which are preferred from the viewpoint of handling stability and cost.

A dry heat stretching process, a steam stretching process or the like may be carried out additionally after the drying process.

Stabilization and Carbonization Process

Described next is the production method for a carbon fiber. The production method for a carbon fiber bundle is intended to produce a carbon fiber bundle by carrying out a stabilization process designed so that the precursor fiber bundle for carbon fiber prepared by the aforementioned method is stabilized in an oxidizing atmosphere at a temperature of 200° C. to 300° C., a pre-carbonization process for performing pre-carbonization treatment in an inert atmosphere at a maximum temperature of 500° C. to 1,200° C., and a subsequent carbonization process for performing carbonization treatment in an inert atmosphere at a maximum temperature of 1,200° C. to 2,000° C.

Air is adopted suitably as the oxidizing atmosphere for the stabilization process. Pre-carbonization treatment and carbonization treatment are performed in an inert atmosphere. Good gases for the inert atmosphere include nitrogen, argon, and xenon, of which nitrogen is preferred from an economical point of view.

Surface Modification Process

The resulting carbon fiber bundle may be subjected to electrochemical treatment for surface modification. Electrolytic treatment is effective because it can ensure optimized adhesion to the matrix for carbon fiber in the resulting fiber reinforced composite material. Such electrochemical treatment may be followed by sizing treatment to allow the resulting carbon fiber bundle to have high convergency. Depending on the type of resin in use, a sizing agent that is highly compatible with the matrix resin may be selected appropriately for use as the aforementioned sizing agent.

Carbon Fiber Bundle

The carbon fiber bundle that is produced is characterized in that a point where the ratio between the number of Si atoms and that of the C atoms, referred to as the Si/C ratio, is 10 or more as calculated by SIMS (secondary ion mass spectrometry) exists in the region of 0 to 10 nm in depth from the monofilament fiber surface and also that the Si/C ratio is 1.0 or less as calculated by SIMS at a depth of 10 nm from the monofilament fiber surface. If the Si/C ratio is 10 or less over the entire region ranging from 0 to 10 nm in depth, it indicates that adhesion between fibers is not suppressed sufficiently, leading to a decrease in strand tensile strength. In addition, if the Si/C ratio is more than 1.0 at a depth of 10 nm from the fiber surface, it indicates that the oil agent has penetrated into the fiber surface layer to induce the formation of void flaws in the surface layer and that Si atoms are contained in the fiber surface layer to cause a decrease in strand tensile strength. Furthermore, if the Si/C ratio is 0.5 or less at a depth of 50 nm from the fiber surface, it indicates that the penetration of the oil agent is suppressed not only in the fiber surface layer but also in the inner layer, and it is preferable because it develops a high strand tensile strength. For SIMS measurement, a carbon fiber bundle is aligned appropriately and primary ions are applied to the fiber surface using the undermentioned measuring apparatus under the undermentioned measuring conditions while analyzing the secondary ions generated. If the carbon fiber bundle under measurement has a sizing agent attached thereon, an evaluation should be made after removing the sizing agent by Soxhlet extraction using an organic solvent that dissolves the sizing agent.

Apparatus: SIMS4550, manufactured by FEI
- primary ion species: $O_2^+$
- primary ion energy: 3 keV
- detected secondary ion polarity: positive ion
- electrification compensation: electron gun
- primary ion incidence angle: 0°

For the carbon fiber bundle, it is preferable that the number of voids with a long diameter of 3 nm or more existing in the region ranging from the fiber surface to a depth of 50 nm in a monofilament cross section is 50 or less and that the average void width is 3 to 15 nm. To develop a high strand tensile strength, the number of voids existing in the region ranging from the fiber surface to a depth of 50 nm is preferably smaller and, accordingly, it is preferably 30 or less, more preferably 10 or less. Furthermore, a smaller average void width leads to the development of a higher strand tensile strength and, accordingly, it is preferably 3 to 10 nm, more preferably 3 to 5 nm. The average void width means the arithmetic average of long diameter measurements of voids as calculated by the procedure described below. The number and average width of voids in a cross section of a carbon fiber bundle are determined as described below. First, sections with a thickness of 100 nm are prepared in the fiber axis direction and the vertical direction of the carbon fiber bundle using focused ion beams (FIB), and the cross sections of the carbon fiber were observed by transmission electron microscopy (TEM) at a magnification of 10,000. For a white portion in the observed image, which represents a void, existing in the region ranging from the fiber surface to a depth of 50 nm, the longest distance between two points on the edge of the void is defined as its long diameter. To determine the number of voids, all voids with a long diameter of 3 nm or more existing in a cross section are counted up. The average void width means the arithmetic average of long diameter measurements of all voids with a long diameter of 3 nm or more existing in the observed image.

The strand tensile strength and strand tensile elastic modulus of a carbon fiber bundle are determined by the following procedure according to the resin-impregnated strand strength test method specified in JIS-R-7608 (2004). The resin mixture to use should consist of Celloxide (registered trademark) 2021P, boron trifluoride monoethylamine, and acetone mixed at a ratio of 100/3/4 (parts by mass), and curing should be performed under conditions including atmospheric pressure, a temperature of 125° C., and a time of 30 minutes. Ten strands formed of carbon fiber bundles are examined and the measurements taken are averaged to determine the strand tensile strength and the strand tensile elastic modulus. If the strand tensile elastic modulus is too small, the strand tensile strength will decrease, whereas if it is too large, the strand tensile strength will decrease and, accordingly, it is preferable to set a strand tensile elastic modulus of 200 to 450 GPa, more preferably 250 to 400 GPa, and still more preferably 270 to 400 GPa.

The carbon fiber bundle has a crystallite size (Lc) of 1.0 to 3.0 nm as determined by wide-angle X-ray diffraction. If the crystallite size is too small, the strand tensile strength will decrease, whereas if it is too large, the strand tensile strength will decrease and, accordingly, it is preferably 1.5 to 2.8 nm, more preferably 2.0 to 2.8 nm. Carbon fiber is a polycrystal containing substantially innumerable graphite crystallites. As the maximum temperature for carbonization treatment is raised, the crystal size increases and at the same time the degree of crystal orientation also increases, allowing the carbon fiber to have an increased strand tensile elastic modulus. If the crystallite size is 1.0 nm or more, the strand tensile elastic modulus of the carbon fiber can be improved, but if the crystallite size is larger than 3.0 nm, the strand tensile strength decreases although the strand tensile elastic modulus increases. The crystallite size is measured under the conditions described below.

X-ray source: CuKα ray (tube voltage 40 kV, tube current 30 mA)

detector: goniometer+monochromator+scintillation counter scanning range: 2θ=10° to 40° scanning mode: step scan, step unit 0.01°, scanning speed 1°/min

In the diffraction pattern obtained, the half-width of the peak appearing in the vicinity of 2θ=25° to 26° is measured, and the crystallite size is calculated from this value by equation (1).

$$\text{crystallite size (nm)} = K\lambda/\beta_0 \cos\theta_B \quad (1)$$

wherein

K: 1.0, λ: 0.15418 nm (wavelength of X-ray)

$\beta_0$: $(\beta E_2 - \beta_1^2)^{1/2}$ $\beta_E$: apparent full width at half maximum (measured) rad, $\beta_1$: $1.046\times10^{-2}$ rad $\theta_B$: Bragg diffraction angle

EXAMPLES

Example 1

A polyacrylonitrile copolymer containing a copolymer of acrylonitrile and itaconic acid was dissolved in dimethyl sulfoxide to prepare a spinning dope solution. The resulting spinning dope solution was extruded first from the spinneret into the air and introduced into a coagulation bath liquid that was prepared by mixing 80 mass % of dimethylsulfoxide and 20% of water, which was adopted as coagulation accelerator, and that had a temperature controlled at 5° C. Then, it was taken up while maintaining the immersion time in the coagulation bath liquid at 0.2 s to prepare a coagulated fiber bundle. Hereinafter, this process for producing a coagulated fiber bundle is referred to simply as the coagulation process.

Subsequently, it was followed by the in-air holding process in which the coagulated fiber bundle was held in the air for 120 s. In the liquid existing around the coagulated fiber bundle coming to a position 0.3 second before being introduced into the washing bath, the organic solvent had a concentration of 87%, which was higher than the concentration of the organic solvent in the coagulation bath liquid, thus proving that the fiber bundle was in a semi-coagulated state when passing through the coagulation bath liquid and continued to coagulate in the air.

Then, the coagulated fiber was washed after being introduced into a washing bath in the washing process in water and then sent to a stretching process in which it was stretched in a bath containing 90° C. warm water. In these processes, the total stretching ratio was 2.3. Subsequently, an oil agent application process was carried out to apply an amino-modified silicone based silicone oil agent to the fiber bundle. Then, drying treatment was performed using a heated roller maintained at 180° C. and five-fold stretching was carried out in compressed steam to achieve a total stretching ratio of 11.5 over the entire fiber production process, thereby providing a polyacrylonitrile based precursor fiber bundle having a monofilament fineness of 1.0 dtex.

Next, the resulting polyacrylonitrile based precursor fiber bundle was treated in the stabilization and carbonization processes described below to provide a carbon fiber bundle.

In the stabilization process, the polyacrylonitrile based precursor fiber bundle obtained above was subjected to stabilization treatment in the air at a temperature of 200° C. to 300° C. to provide a stabilized fiber bundle.

The stabilized fiber bundle resulting from the stabilization process was sent to a pre-carbonization process in which pre-carbonization treatment was performed in a nitrogen atmosphere at a maximum temperature of 800° C. to provide a pre-carbonized fiber bundle.

The pre-carbonized fiber bundle resulting from the pre-carbonization process was sent to a carbonization process in which carbonization treatment was performed in a nitrogen atmosphere at a maximum temperature of 1,500° C.

Following this, electrochemical treatment of the fiber surface was performed using an aqueous sulfuric acid solution as electrolyte, followed by washing in water, drying, and application of a sizing agent to provide a carbon fiber bundle. The spinning conditions and physical properties of the resulting carbon fibers are summarized in Table 1, and details of Examples and Comparative Examples given below are also summarized in Tables 1 to 4. The strand tensile strength was 6.3 GPa.

Example 2

Except that the immersion period in the coagulation bath liquid in the coagulation process was set to 3.7 s, the same procedure as in Example 1 was carried out. In the in-air holding process, the liquid existing around the coagulated fiber bundle coming to a position 0.3 second before being introduced into the washing bath had an organic solvent concentration of 82%, which was lower than in Example 1, suggesting that the fiber bundle continued to coagulate to some degree in the coagulation bath liquid. Compared to Example 1, both the Si/C ratio at a depth of 10 nm from the fiber surface layer and the Si/C ratio at a depth of 50 nm from the fiber surface layer were higher and the number and average width of voids with a long diameter of 3 nm or more existing in the region ranging from the fiber surface to a depth of 50 nm were larger. The strand tensile strength was 5.8 GPa, which was smaller than in Example 1. Hereinafter, the number of voids with a long diameter of 3 nm or more existing in the region ranging from the fiber surface to a depth of 50 nm is referred to simply as the number of voids in the surface layer.

Example 3

Except that the immersion period in the coagulation bath liquid in the coagulation process was set to 0.8 s and that the in-air holding period in the in-air holding process was set to 12 s, the same procedure as in Example 1 was carried out. The strand tensile strength was 6.2 GPa.

Example 4

Except that the in-air holding period in the in-air holding process was set to 35 s, the same procedure as in Example 3 was carried out. The strand tensile strength was 6.4 GPa, which represented an improvement of 0.2 GPa compared to Example 3.

Example 5

Except that the in-air holding period in the in-air holding process was set to 120 s, the same procedure as in Example 3 was carried out. The strand tensile strength was 6.5 GPa, which represented an improvement of 0.1 GPa compared to Example 4.

Example 6

Except that the in-air holding period in the in-air holding process was set to 200 s, the same procedure as in Example 3 was carried out. The strand tensile strength was 6.5 GPa, which was as large as in Example 5, indicating that the densification brought about by in-air coagulation had been completed in about 120 s.

Example 7

Except that the immersion period in the coagulation bath liquid in the coagulation process was set to 1.5 s, the same procedure as in Example 1 was carried out. The strand tensile strength was 5.8 GPa.

Example 8

Except that the temperature of the coagulation bath liquid in the coagulation process was set to 15° C., the same procedure as in Example 7 was carried out. The temperature of the coagulation bath liquid was so high that the number of voids in the surface layer was larger than in Example 7. The strand tensile strength was 5.6 GPa.

Example 9

Except that the temperature of the coagulation bath liquid in the coagulation process was set to −5° C., the same procedure as in Example 7 was carried out. The temperature of the coagulation bath liquid was so low that the Si/C ratio at a depth of 10 nm from the fiber surface layer was smaller than in Example 7 and the number of voids in the surface layer was smaller than in Example 8. The strand tensile strength was 6.1 GPa.

Example 10

Except that the temperature of the coagulation bath liquid in the coagulation process was set to −20° C., the same procedure as in Example 7 was carried out. The temperature of the coagulation bath liquid was so low that the Si/C ratio at a depth of 10 nm from the fiber surface layer was still smaller than in Example 9 and the number of voids in the surface layer was also smaller. The strand tensile strength was 6.4 GPa.

Example 11

Except that the concentration of the organic solvent in the coagulation bath liquid in the coagulation process was set to 85%, the same procedure as in Example 7 was carried out. The Si/C ratio at a depth of 10 nm from the fiber surface layer was smaller than in Example 7, but the concentration of the organic solvent was so high that the number of voids in the surface layer was larger than in Example 7. The strand tensile strength was 5.8 GPa, which was as large as in Example 7.

Example 12

Except that the concentration of the organic solvent in the coagulation bath liquid in the coagulation process was set to 83%, the same procedure as in Example 7 was carried out. The number of voids in the surface layer was smaller than in Example 11, and the strand tensile strength was 5.9 GPa, which represented an improvement of 0.1 GPa compared to Example 7.

Example 13

Except that the concentration of the organic solvent in the coagulation bath liquid in the coagulation process was set to 75%, the same procedure as in Example 7 was carried out. Both the Si/C ratio at a depth of 10 nm from the fiber surface layer and the number of voids in the surface layer were as large as in Example 7. The strand tensile strength was 5.8 GPa, which was also as large as in Example 7.

Example 14

Except that dimethyl acetamide was used as the organic solvent in the polyacrylonitrile copolymer solution, i.e., spinning dope solution, and that dimethyl acetamide was used as the organic solvent in the coagulation bath liquid in the coagulation process, the same procedure as in Example 7 was carried out. Compared to Example 7, there was little difference in the Si/C ratio at a depth of 10 nm from the fiber surface layer and the Si/C ratio at a depth of 50 nm from the fiber surface layer, as well as in the number and average width of voids in the surface layer. The strand tensile strength was 5.7 GPa, which was also little different from Example 7 as well.

Example 15

Except that dimethyl formamide was used as the organic solvent in the polyacrylonitrile copolymer solution, i.e., spinning dope solution, and that dimethyl formamide was used as the organic solvent in the coagulation bath liquid, the same procedure as in Example 7 was carried out. Compared to Example 7, there was little difference in the Si/C ratio at a depth of 10 nm from the fiber surface layer and the Si/C ratio at a depth of 50 nm from the fiber surface layer, as well as in the number and average width of voids in the surface layer. The strand tensile strength was 5.8 GPa, which was as large as in Example 7.

Comparative Example 1

Except that the immersion period in the coagulation bath liquid in the coagulation process was set to 10.0 s and that the in-air holding period in the in-air holding process was set to 10 s, the same procedure as in Example 1 was carried out. In the in-air holding process, the liquid existing around the coagulated fiber bundle coming to a position 0.3 second before being introduced into the washing bath had an organic solvent concentration of 80%, which was the same as the concentration of the organic solvent in the coagulation bath liquid in the coagulation process, indicating that coagulation had been completed in the coagulation bath liquid. Compared to Example 1, the Si/C ratio at a depth of 10 nm from the fiber surface layer and the Si/C ratio at a depth of 50 nm from the fiber surface layer were larger, and the number and average width of voids in the surface layer were also larger. Accordingly, the strand tensile strength was 5.1 GPa, which was smaller by 1.2 GPa.

Comparative Example 2

Except that the immersion period in the coagulation bath liquid in the coagulation process was set to 7.0 s, the same procedure as in Example 7 was carried out. In the in-air holding process, the liquid existing around the coagulated fiber bundle coming to a position 0.3 second before being introduced into the washing bath had an organic solvent concentration of 81%, which was only 1% higher than the concentration of the organic solvent in the coagulation bath liquid in the coagulation process, indicating that coarse coagulation had been completed in the coagulation bath liquid. Compared to Example 7, the Si/C ratio at a depth of 10 nm from the fiber surface layer and the number and average width of voids in the surface layer were larger and, accordingly, the strand tensile strength was 5.2 GPa, which was smaller by 0.6 GPa.

Comparative Example 3

Except that the immersion period in the coagulation bath liquid in the coagulation process was set to 5.0 s, the same procedure as in Example 7 was carried out. The strand tensile strength was 5.2 GPa, which was little different from Comparative Example 2.

Comparative Example 4

Except that the immersion period in the coagulation bath liquid in the coagulation process was set to 1.5 s and that the in-air holding period in the in-air holding process was set to 1 s, the same procedure as in Example 7 was carried out. In the in-air holding process, the liquid existing around the coagulated fiber bundle coming to a position 0.3 second before being introduced into the washing bath had an organic solvent concentration of 80%, which was the same as the concentration of the organic solvent in the coagulation bath liquid in spite of the same coagulation conditions as in Example 7. Although being in a semi-coagulated state when passing through the coagulation bath liquid, the fiber bundle was introduced into the washing bath before being coagulated sufficiently in the air. The strand tensile strength was 5.1 GPa, which represented a decrease of 0.7 GPa compared to Example 7.

Comparative Example 5

Except that the in-air holding period in the in-air holding process was set to 3 s, the same procedure as in Comparative Example 4 was carried out. The strand tensile strength was 5.2, which represented a decrease of 0.6 GPa compared to Example 7.

Comparative Example 6

Except that the in-air holding period in the in-air holding process was set to 7 s, the same procedure as in Comparative Example 5 was carried out. The strand tensile strength was 5.2 GPa, which was nearly the same as in Comparative Example 5.

Comparative Example 7

Except that the concentration of the organic solvent in the coagulation bath liquid in the coagulation process was set to 25%, the same procedure as in Example 2 was carried out. In the in-air holding process, the liquid existing around the coagulated fiber bundle coming to a position 0.3 second before being introduced into the washing bath had an organic solvent concentration of 25%, which was the same as the concentration of the organic solvent in the coagulation bath liquid in the coagulation process. The concentration of the organic solvent in the coagulation bath liquid was so low that the coagulation rate was high and coagulation had been completed in the coagulation bath liquid. The strand tensile strength was 5.1 GPa, which represented a decrease of 0.7 GPa compared to Example 2.

Comparative Example 8

Except that the concentration of the organic solvent in the coagulation bath liquid in the coagulation process was set to 65%, the same procedure as in Example 2 was carried out. The strand tensile strength was 5.0 GPa, which represented a decrease of 0.8 GPa compared to Example 2.

Comparative Example 9

Except that the temperature of the coagulation bath liquid in the coagulation process was set to 30° C., the same procedure as in Example 7 was carried out. The strand tensile strength was 4.8 GPa, which represented a decrease of 1.2 GPa compared to Example 7.

Comparative Example 10

Except that the temperature of the coagulation bath liquid in the coagulation process was set to −30° C., the same procedure as in Example 7 was carried out. The strand tensile strength was 4.6 GPa, which represented a decrease of 1.4 GPa compared to Example 7. Heavy fuzz was also seen.

Comparative Example 11

Except that the immersion period in the coagulation bath liquid in the coagulation process was set to 10.0 s, the same procedure as in Example 14 was carried out. The strand tensile strength was 5.2 GPa, which represented a decrease of 0.5 GPa compared to Example 14.

Comparative Example 12

Except that the immersion period in the coagulation bath liquid in the coagulation process was set to 10.0 s, the same procedure as in Example 15 was carried out. The strand tensile strength was 5.2 GPa, which represented a decrease of 0.6 GPa compared to Example 15.

Comparative Example 13

Except that the amount of the amino-modified silicone supplied in the oil agent application process was smaller than in Comparative Example 1, the same procedure as in Comparative Example 1 was carried out. The Si/C ratio at a depth of 10 nm from the fiber surface layer, the Si/C ratio at a depth of 50 nm from the fiber surface layer, and the number and average width of voids in the surface layer were smaller than in Comparative Example 1. However, the Si/C ratio was small in the depth range of 0 to 10 nm from the fiber surface, and due to adhesion between fibers, the strand tensile strength was 4.9 GPa, which was smaller by 0.2 GPa than in Comparative Example 1.

Comparative Example 14

Except that the amount of the amino-modified silicone supplied in the oil agent application process was smaller than in Comparative Example 13, the same procedure as in Comparative Example 13 was carried out. The Si/C ratio at a depth of 10 nm from the fiber surface layer and the Si/C ratio at a depth of 50 nm from the fiber surface layer were smaller than in Comparative Example 13. However, the Si/C ratio was small in the depth range of 0 to 10 nm from the fiber surface and, due to adhesion between fibers, the strand tensile strength was 4.5 GPa, which was smaller by 0.4 GPa than in Comparative Example 13.

Comparative Example 15

Except that the total stretching ratio before the oil agent application process was 3.0, the same procedure as in Comparative Example 1 was carried out. The Si/C ratio at a depth of 50 nm from the fiber surface layer and the number and average width of voids in the surface layer were smaller than in Comparative Example 1. However, the Si/C ratio at a depth of 10 nm from the fiber surface layer was larger and the strand tensile strength was 5.3 GPa, which was larger by only 0.2 GPa than in Comparative Example 1.

Comparative Example 16

Except that the total stretching ratio before the oil agent application process was 4.0, the same procedure as in Comparative Example 1 was carried out. The Si/C ratio at a depth of 50 nm from the fiber surface layer and the number and average width of voids was decreased surface layer were smaller than in Comparative Example 1. However, the Si/C ratio at a depth of 10 nm from the fiber surface layer was much larger and the strand tensile strength was 5.0 GPa, which was smaller by 0.1 GPa than in Comparative Example 1.

TABLE 1

| | coagulation process | | | | in-air holding process | | | stretching process |
|---|---|---|---|---|---|---|---|---|
| | coagulation bath liquid | | coagulation | coagulation | | organic solvent concentration in the liquid existing around coagulated fiber bundle immediately | | stretching |
| | components | organic solvent concentration (A) (%) | bath liquid temperature (° C.) | bath liquid immersion period (s) | in-air holding period (s) | before being introduced into washing bath (B) (%) | (B-A) (%) | ratio before oil agent application |
| Example 1 | water 20/DMSO80 | 80 | 5 | 0.2 | 120 | 87 | 7 | 2.3 |
| Example 2 | water 20/DMSO80 | 80 | 5 | 3.7 | 120 | 82 | 2 | 2.3 |
| Example 3 | water 20/DMSO80 | 80 | 5 | 0.8 | 12 | 85 | 5 | 2.3 |
| Example 4 | water 20/DMSO80 | 80 | 5 | 0.8 | 35 | 86 | 6 | 2.3 |
| Example 5 | water 20/DMSO80 | 80 | 5 | 0.8 | 120 | 86 | 6 | 2.3 |
| Example 6 | water 20/DMSO80 | 80 | 5 | 0.8 | 200 | 87 | 7 | 2.3 |
| Example 7 | water 20/DMSO80 | 80 | 5 | 1.5 | 120 | 84 | 4 | 2.3 |
| Example 8 | water 20/DMSO80 | 80 | 15 | 1.5 | 120 | 82 | 2 | 2.3 |
| Example 9 | water 20/DMSO80 | 80 | −5 | 1.5 | 120 | 85 | 5 | 2.3 |
| Example 10 | water 20/DMSO80 | 80 | −20 | 1.5 | 120 | 86 | 6 | 2.3 |
| Example 11 | water 15/DMSO85 | 85 | 5 | 1.5 | 120 | 90 | 5 | 2.3 |
| Example 12 | water 17/DMSO83 | 83 | 5 | 1.5 | 120 | 87 | 4 | 2.3 |
| Example 13 | water 25/DMSO75 | 75 | 5 | 1.5 | 120 | 78 | 3 | 2.3 |
| Example 14 | water 20/DMAC80 | 80 | 5 | 1.5 | 120 | 84 | 4 | 2.3 |
| Example 15 | water 20/DMF80 | 80 | 5 | 1.5 | 120 | 85 | 5 | 2.3 |

TABLE 2

| | maximum Si/C ratio in 0 to 10 nm depth region from fiber surface | Si/C ratio at depth of 10 nm from fiber surface | Si/C ratio at depth of 50 nm from fiber surface | number of voids with long diameter of 3 nm or more | average width of voids (nm) | crystallite size (nm) | strand tensile strength (GPa) | strand tensile elastic modulus (GPa) |
|---|---|---|---|---|---|---|---|---|
| Example 1 | 11 | 0.5 | 0.2 | 13 | 6 | 2.4 | 6.3 | 304 |
| Example 2 | 10 | 0.9 | 0.4 | 24 | 10 | 2.4 | 5.8 | 301 |

TABLE 2-continued

| | maximum Si/C ratio in 0 to 10 nm depth region from fiber surface | Si/C ratio at depth of 10 nm from fiber surface | Si/C ratio at depth of 50 nm from fiber surface | number of voids with long diameter of 3 nm or more | average width of voids (nm) | crystallite size (nm) | strand tensile strength (GPa) | strand tensile elastic modulus (GPa) |
|---|---|---|---|---|---|---|---|---|
| Example 3 | 11 | 0.7 | 0.2 | 14 | 7 | 2.4 | 6.2 | 303 |
| Example 4 | 10 | 0.6 | 0.2 | 11 | 6 | 2.4 | 6.4 | 299 |
| Example 5 | 12 | 0.5 | 0.1 | 9 | 5 | 2.4 | 6.5 | 303 |
| Example 6 | 11 | 0.5 | 0.1 | 9 | 5 | 2.4 | 6.5 | 303 |
| Example 7 | 11 | 0.8 | 0.3 | 19 | 7 | 2.4 | 5.8 | 301 |
| Example 8 | 10 | 0.9 | 0.7 | 46 | 15 | 2.4 | 5.6 | 298 |
| Example 9 | 11 | 0.6 | 0.3 | 23 | 7 | 2.4 | 6.1 | 303 |
| Example 10 | 13 | 0.5 | 0.2 | 14 | 5 | 2.4 | 6.4 | 304 |
| Example 11 | 11 | 0.7 | 0.4 | 46 | 7 | 2.4 | 5.8 | 298 |
| Example 12 | 11 | 0.7 | 0.4 | 35 | 8 | 2.4 | 5.9 | 300 |
| Example 13 | 12 | 0.8 | 0.4 | 16 | 7 | 2.4 | 5.8 | 303 |
| Example 14 | 11 | 0.8 | 0.4 | 21 | 7 | 2.4 | 5.7 | 298 |
| Example 15 | 11 | 0.7 | 0.3 | 19 | 8 | 2.4 | 5.8 | 302 |

TABLE 3

| | coagulation process | | | | in-air holding process | | | stretching process |
|---|---|---|---|---|---|---|---|---|
| | coagulation bath liquid | | coagulation | coagulation | | organic solvent concentration in the liquid existing around coagulated fiber bundle immediately | | stretching |
| | composition | organic solvent concentration (A) (%) | bath liquid temperature (° C.) | bath liquid immersion period (s) | in-air holding period (s) | before being introduced into washing bath (B) (%) | (B-A) (%) | ratio before oil agent application |
| Comparative Example 1 | water 20/ DMSO80 | 80 | 5 | 10.0 | 10 | 80 | 0 | 2.3 |
| Comparative Example 2 | water 20/ DMSO80 | 80 | 5 | 7.0 | 120 | 81 | 1 | 2.3 |
| Comparative Example 3 | water 20/ DMSO80 | 80 | 5 | 5.0 | 120 | 81 | 1 | 2.3 |
| Comparative Example 4 | water 20/ DMSO80 | 80 | 5 | 1.5 | 1 | 80 | 0 | 2.3 |
| Comparative Example 5 | water 20/ DMSO80 | 80 | 5 | 1.5 | 3 | 81 | 1 | 2.3 |
| Comparative Example 6 | water 20/ DMSO80 | 80 | 5 | 1.5 | 7 | 82 | 2 | 2.3 |
| Comparative Example 7 | water 75/ DMSO25 | 25 | 5 | 3.7 | 120 | 25 | 0 | 2.3 |
| Comparative Example 8 | water 35/ DMSO65 | 65 | 5 | 3.7 | 120 | 65 | 0 | 2.3 |
| Comparative Example 9 | water 20/ DMSO80 | 80 | 30 | 1.5 | 120 | 81 | 1 | 2.3 |
| Comparative Example 10 | water 20/ DMSO80 | 80 | −30 | 1.5 | 120 | 86 | 6 | 2.3 |
| Comparative Example 11 | water 20/ DMAC80 | 80 | 5 | 10.0 | 120 | 80 | 0 | 2.3 |
| Comparative Example 12 | water 20/ DMF80 | 80 | 5 | 10.0 | 120 | 80 | 0 | 2.3 |
| Comparative Example 13 | water 20/ DMSO80 | 80 | 5 | 10.0 | 10 | 80 | 0 | 2.3 |
| Comparative Example 14 | water 20/ DMSO80 | 80 | 5 | 10.0 | 10 | 80 | 0 | 2.3 |

TABLE 3-continued

| | coagulation process | | | | in-air holding process | | | stretching process |
|---|---|---|---|---|---|---|---|---|
| | coagulation bath liquid | | coagulation | coagulation | | organic solvent concentration in the liquid existing around coagulated fiber bundle immediately | | stretching |
| | composition | organic solvent concentration (A) (%) | bath liquid temperature (° C.) | bath liquid immersion period (s) | in-air holding period (s) | before being introduced into washing bath (B) (%) | (B-A) (%) | ratio before oil agent application |
| Comparative Example 15 | water 20/ DMSO80 | 80 | 5 | 10.0 | 10 | 80 | 0 | 3.0 |
| Comparative Example 16 | water 20/ DMSO80 | 80 | 5 | 10.0 | 10 | 80 | 0 | 4.0 |

TABLE 4

| | maximum Si/C ratio in 0 to 10 nm depth region from fiber surface | Si/C ratio at depth of 10 nm from fiber surface | Si/C ratio at depth of 50 nm from fiber surface | number of voids with long diameter of 3 nm or more | average width of voids (nm) | crystallite size (nm) | strand tensile strength (GPa) | strand tensile elastic modulus (GPa) |
|---|---|---|---|---|---|---|---|---|
| Comparative Example 1 | 11 | 1.2 | 0.3 | 25 | 9 | 2.4 | 5.1 | 302 |
| Comparative Example 2 | 12 | 1.3 | 0.3 | 29 | 10 | 2.4 | 5.2 | 303 |
| Comparative Example 3 | 11 | 1.2 | 0.3 | 22 | 8 | 2.4 | 5.2 | 301 |
| Comparative Example 4 | 10 | 1.5 | 0.6 | 43 | 8 | 2.4 | 5.1 | 298 |
| Comparative Example 5 | 11 | 1.4 | 0.4 | 41 | 8 | 2.4 | 5.2 | 303 |
| Comparative Example 6 | 12 | 1.2 | 0.4 | 34 | 9 | 2.4 | 5.2 | 301 |
| Comparative Example 7 | 12 | 1.6 | 0.4 | 39 | 12 | 2.4 | 5.1 | 304 |
| Comparative Example 8 | 10 | 1.5 | 0.4 | 36 | 11 | 2.4 | 5.0 | 300 |
| Comparative Example 9 | 10 | 1.9 | 0.3 | 58 | 14 | 2.4 | 4.8 | 304 |
| Comparative Example 10 | 12 | 1.1 | 0.3 | 15 | 8 | 2.4 | 4.6 | 301 |
| Comparative Example 11 | 11 | 1.2 | 0.4 | 28 | 7 | 2.4 | 5.2 | 299 |
| Comparative Example 12 | 11 | 1.3 | 0.3 | 23 | 8 | 2.4 | 5.2 | 301 |
| Comparative Example 13 | 6 | 0.8 | 0.2 | 22 | 8 | 2.4 | 4.9 | 302 |
| Comparative Example 14 | 3 | 0.5 | 0.1 | 24 | 9 | 2.4 | 4.5 | 300 |
| Comparative Example 15 | 10 | 1.7 | 0.1 | 14 | 5 | 2.4 | 5.3 | 302 |
| Comparative Example 16 | 11 | 2.5 | 0.1 | 9 | 4 | 2.4 | 5.0 | 300 |

The invention claimed is:

1. A carbon fiber bundle comprising:

a crystallite size (Lc) of 1.0 to 3.0 nm or less as measured by wide-angle X-ray diffraction, containing a point where the Si/C ratio is 10 or more as calculated by secondary ion mass spectrometry in a region ranging from 0 to 10 nm in depth from the fiber surface, and having a Si/C ratio of 1.0 or less as calculated by secondary ion mass spectrometry at a depth of 10 nm from the fiber surface;

wherein the carbon fiber bundle is made by extruding a polyacrylonitrile copolymer solution from a spinneret into the air, immersing the solution in a coagulation bath liquid stored in a coagulation bath, pulling semi-coagulated solution out from the coagulation bath liquid into the air to form a coagulated fiber bundle, subsequently carrying out at least a washing process in water, a stretching process, an oil agent application process, and a drying process to form a precursor fiber bundle for carbon fiber, carrying out a stabilization process to stabilize the precursor fiber bundle in an oxidizing atmosphere at a temperature of 200° C. to 300° C., performing pre-carbonization treatment in an inert atmosphere at a maximum temperature of 500° C. to 1,200° C., and performing carbonization treatment in an inert atmosphere at a maximum temperature of 1,200° C. to 2,000° C., wherein the coagulation bath liquid contains 70% to 85% of at least one organic solvent selected from the group consisting of dimethyl sulfoxide, dimethyl formamide, and dimethyl acetamide, and has a temperature of −20° C. to 20° C.; the immersion period of the polyacrylonitrile copolymer solution in the coagulation bath liquid is 0.1 to 4 seconds; and an in-air holding process for holding the coagulated fiber bundle in the air for 10 seconds or more is perform after pulling it out from the coagulation bath liquid into the air and before performing the washing process in water.

* * * * *